US008893806B2

(12) United States Patent
Williamson et al.

(10) Patent No.: US 8,893,806 B2
(45) Date of Patent: Nov. 25, 2014

(54) EXERCISING A WELL TOOL

(71) Applicant: Halliburton Energy Services, Inc., Houston, TX (US)

(72) Inventors: Jimmie Robert Williamson, Carrollton, TX (US); James Dan Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/759,257

(22) Filed: Feb. 5, 2013

(65) Prior Publication Data

US 2013/0199795 A1 Aug. 8, 2013

(30) Foreign Application Priority Data

Feb. 6, 2012 (WO) ..... PCT/US2012/023937

(51) Int. Cl.
*E21B 34/14* (2006.01)
*E21B 34/10* (2006.01)
*E21B 47/00* (2012.01)

(52) U.S. Cl.
CPC ..... *E21B 34/14* (2013.01); *E21B 34/10* (2013.01); *E21B 47/00* (2013.01)
USPC ..... 166/374; 166/386; 166/332.1; 166/319; 166/332.4

(58) Field of Classification Search
USPC ..... 166/332.5, 332.4, 374, 375, 386, 332, 166/324, 332.8, 192, 193, 194, 322, 319, 166/332.1
See application file for complete search history.

(56) References Cited

U.S. PATENT DOCUMENTS

| | | | | |
|---|---|---|---|---|
| 3,310,114 | A * | 3/1967 | Dollison | 166/322 |
| 3,696,868 | A * | 10/1972 | Taylor, Jr. | 166/375 |
| 4,378,931 | A * | 4/1983 | Adams, Jr. | 251/58 |
| 4,944,351 | A * | 7/1990 | Eriksen et al. | 166/376 |
| 5,249,630 | A * | 10/1993 | Meaders et al. | 166/373 |
| 5,474,142 | A | 12/1995 | Bowden | |
| 6,059,041 | A * | 5/2000 | Scott | 166/373 |
| 6,152,232 | A * | 11/2000 | Webb et al. | 166/373 |
| 6,742,595 | B2 | 6/2004 | Dennistoun et al. | |
| 6,902,006 | B2 * | 6/2005 | Myerley et al. | 166/373 |
| 6,978,842 | B2 * | 12/2005 | Read et al. | 166/383 |

(Continued)

OTHER PUBLICATIONS

Authorized officer Choi Soo Jung, International Search Report and Written Opinion in International Application No. PCT/US2012/023937, mailed Nov. 29, 2012, 12 pages.

(Continued)

*Primary Examiner* — Robert E Fuller
(74) *Attorney, Agent, or Firm* — John W. Wustenberg; Fish & Richardson P.C.

(57) ABSTRACT

An exercise tool assembly for operating a downhole tool auxiliary to a primary actuator system of the downhole tool includes a cylinder mandrel configured to be received in the central bore of the downhole tool. A piston mandrel is in and sealed with the cylinder mandrel. The exercise tool assembly is configured to couple to an actuator sleeve of the downhole tool and to couple to the downhole tool at a location apart from the actuator sleeve. The piston mandrel is responsive to a change in pressure in the central bore to translate relative to the cylinder mandrel and translate the coupling with the actuator sleeve relative to the coupling at the location apart from the actuator sleeve.

11 Claims, 5 Drawing Sheets

(56) References Cited

U.S. PATENT DOCUMENTS

| | | | | |
|---|---|---|---|---|
| 7,347,268 | B2 * | 3/2008 | Layton | 166/332.1 |
| 7,918,280 | B2 * | 4/2011 | Mailand et al. | 166/298 |
| 8,191,623 | B2 | 6/2012 | Lynde et al. | |
| 2007/0062687 | A1 | 3/2007 | Layton | |
| 2011/0155381 | A1 | 6/2011 | Reaux | |

OTHER PUBLICATIONS

Halliburton "Slickline Service Equipment and Services," 34 pages, Jul. 2011.

* cited by examiner

EXERCISING A WELL TOOL

BACKGROUND

Many well tools operated in response to a hydraulic signal also have provisions for mechanical operation, for example with a shifting tool of a work string or a wire run actuator tool. Such provisions enable contingent mechanical operation of the well tool when the hydraulic operation is impossible or impracticable. For example, a deep set Surface Controlled Subsurface Safety Valve (SCSSV) can sometimes become inoperable due to well debris and can stick in an open, closed or partially closed position when operated during periodic downhole testing. Because of the small operating piston area of the hydraulic actuator and the limited forces produced by the valve's return spring, it is sometimes not possible to fully operate the SCSSV with the available control line pressure. Wire run and operated exercise tools exist, for example, the Safety Valve Exercise Tool "42TLXXX" made and sold by Halliburton Energy Services, Inc. Such an exercise tool is locked into a profile in the SCSSV flow tube and upward and downward jarring along with control line pressure is used to force movement of the actuator sleeve in the SCSSV. This jarring action is sometimes ineffective because the exercise tool must work against the SCSSV spring, hydraulic piston and the lubricator seal.

SUMMARY

Certain aspects encompass an exercise tool assembly for operating a downhole tool auxiliary to a primary actuator system of the downhole tool. The exercise tool assembly includes a cylinder mandrel configured to be received in the central bore of the downhole tool. A piston mandrel is in and sealed with the cylinder mandrel. The exercise tool assembly is configured to couple to an actuator sleeve of the downhole tool and to couple to the downhole tool at a location apart from the actuator sleeve. The piston mandrel is responsive to a change in pressure in the central bore to translate relative to the cylinder mandrel and translate the coupling with the actuator sleeve relative to the coupling at the location apart from the actuator sleeve.

Certain aspects encompass a method of operating a downhole tool auxiliary to a primary actuator system of the downhole tool. According to the method an exercise tool assembly grips a wall of a central bore of the downhole tool. The exercise tool assembly grips an actuator sleeve of the downhole tool. In response to a pressure change of fluid in the central bore, the exercise tool assembly is operated to shift the actuator sleeve and operate the downhole tool.

Certain aspects encompass a well system. A downhole tool is provided in a wellbore of the well system. The downhole tool has a signal responsive actuation system for actuating the downhole tool in response to a remotely generated signal and an actuator sleeve for manually actuating the downhole tool. An exercise tool assembly is received in the downhole tool. The exercise tool assembly grips the downhole tool at a first location on the actuator sleeve and grips the downhole tool at a second location apart from the actuator sleeve. The exercise tool assembly is responsive to pressure in the downhole tool to translate the first location relative to the second location.

Other features, objects, and advantages will be apparent from the description and drawings, and from the claims.

DESCRIPTION OF DRAWINGS

FIG. 2A depicts the exercise tool assembly coupled to a running tool after having been initially run and located in the SCSSV. FIG. 2B depicts the exercise tool assembly located in the proper position for actuation locked in gripping engagement within the SCSSV. FIG. 2C depicts the exercise tool assembly extended having translated the actuator sleeve of the SCSSV downhole to open the safety valve closure.

Like reference symbols in the various drawings indicate like elements.

DETAILED DESCRIPTION

The present disclosure encompasses a hydraulically operated exercise tool assembly which can operate a well tool auxiliary to the well tool's on-board remote actuator system (i.e., primary actuator system), either to supplement the well tool's actuator system (i.e., both the exercise tool assembly and actuator system being operated to operate the well tool) or to operate the well tool without the actuator system being operated, via the well tool's provisions for mechanical operation. The exercise tool assembly can be used to cycle the well tool uphole and downhole through its operating states, for example, to cycle the tool's actuator sleeve both uphole and downhole, repeatedly. In the context of a SCSSV, the exercise tool assembly can open and close a SCSSV one, two, or more times. The exercise tool assembly need not be supported by or even coupled to a wire (e.g., wireline, slickline, e-line, and/or other) or a tubing string (e.g., coiled tubing, jointed tubing and/or other) when operating the well tool, thus enabling the exercise tool assembly to be run into a well on a running tool via wire or tubing, and then the wire slacked or the running tool and wire or tubing string removed from the well. With the wire or tubing removed from the well, the well can be robustly closed in (e.g., by a downhole or surface valve) and the exercise tool assembly can be hydraulically operated to cycle the well tool without needing a rig or wire capable vessel at the well.

Figure 1:
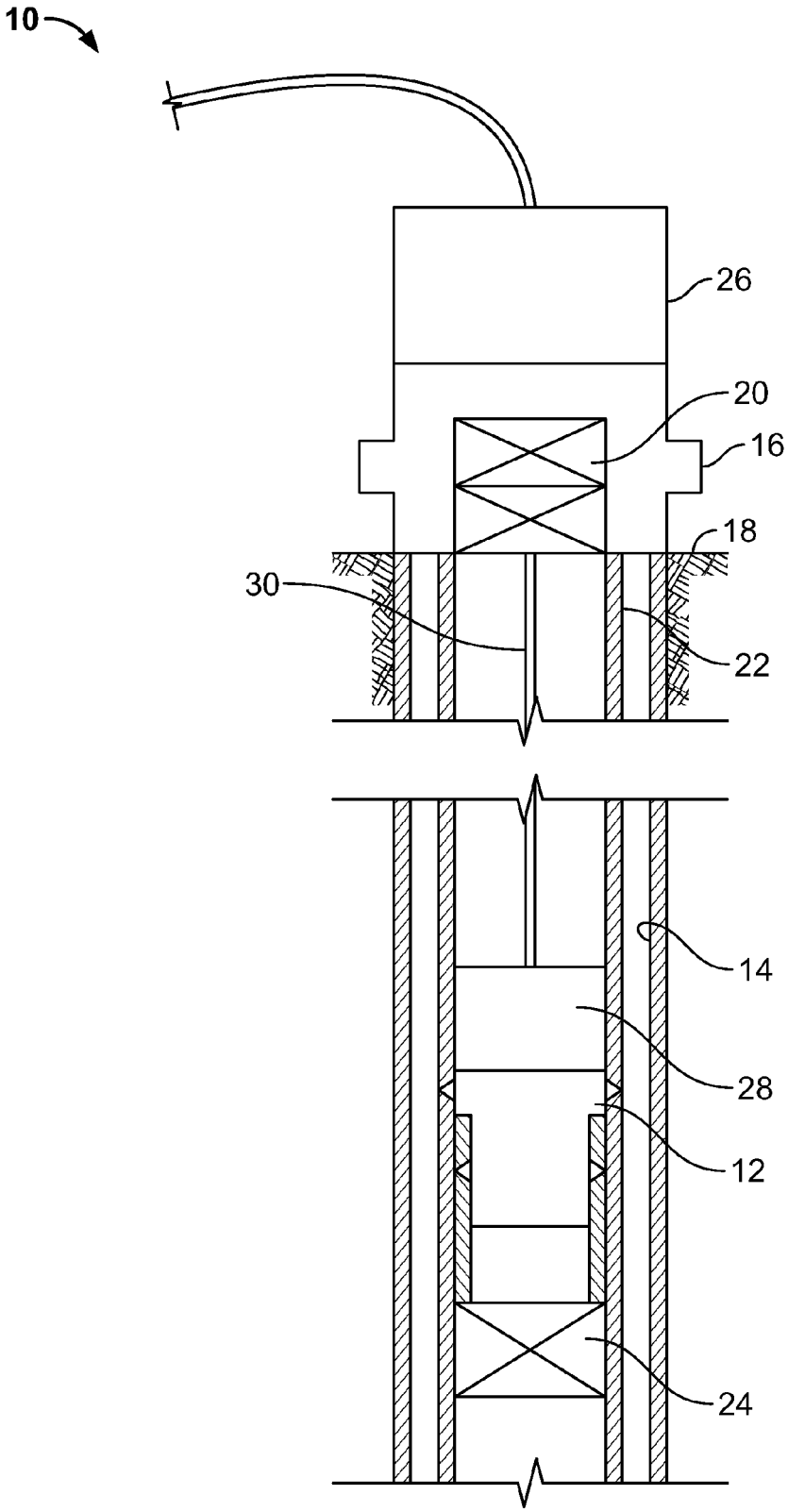
FIG. 1 is a side cross-sectional view of an example well system with an exercise tool assembly.

FIG. 1 depicts an example subsea well system 10 incorporating an exercise tool assembly 12 constructed in accordance with the concepts herein. The well system 10 has a subterranean well bore 14 that extends from a wellhead 16 at the terranean surface 18 into one or more subterranean zones of interest. Here, the well system 10 is a subsea well, so the terranean surface 18 is the sea floor, but the concepts described herein could be equally applied to a surface well system. The wellhead 16 includes one or more valves 20 that can be selectively opened or closed for closing in the well by closing off flow through the wellhead 16. The wellhead 16 may include other components, such as blow out preventers and/or other components. A completion string 22 including tubing and well tools extends downhole from the wellhead 16. Among other things, the completion string 22 includes a well tool 24 to be operated by the exercise tool assembly 12. In certain instances, for example, when the exercise tool assembly 12 is run into the well on a conveyance 30, such as coiled tubing or wire, the wellhead 16 can further include a lubricator 26 to seal around the tubing or wire and seal the well.

The exercise tool assembly 12 is configured to be run into the well bore 14, into the central interior bore of the completion string 22 and well tool 24, carried on a running tool 28 that is coupled with the exercise tool assembly 12. In the example depicted in FIG. 1, the running tool 28 and exercise tool assembly 12 are run in a tool string on wireline, but in other instances, the exercise tool assembly 12 and running tool 28 can be run on tubing (coiled and/or jointed). In certain instances, the tool string further includes wireline jars and stem. Running the exercise tool assembly in a tool string on wireline, slickline or the like enables the tool string to be run into the well system 10 with a vessel having wire handling capabilities. Thus, a rig with jointed tubing or coiled tubing handling capabilities is not needed. Such vessels with only wire handling capabilities are typically smaller and more plentiful, and thus less expensive to hire and operate and easier to schedule than a rig with jointed or coiled tubing handling capabilities.

When run into the well tool 24, the exercise tool assembly 12 initially engages to and grips the well tool 24 at an actuator sleeve of the well tool 24 and at a location apart from the actuator sleeve. Then, the running tool 28 is operated (hydraulically, electrically, by mechanical manipulation and/or otherwise) to lock the exercise tool assembly 12 in gripping engagement with the well tool 24. When the running tool 28 is removed, an equalizing valve of the exercise tool assembly 12 is closed to close off communication of pressure between the central bore of the well tool 24 (as well as the central bore of the exercise tool assembly 12) and the exterior of the exercise tool assembly 12. With the exercise tool assembly 28 in gripping engagement with the well tool 24, the weight of the exercise tool assembly 28 is supported and the exercise tool assembly 28 is anchored in the well tool 24. The running tool 28 can be released from the exercise tool assembly 12 and can be removed from the well 10, along with the remaining tool string and wire (or tubing) the running tool 28 was run in on. Removing the tool string and wire from the well 10 allows the well 10 to be robustly closed-in by the valve 20 at the wellhead 16 for safety. Valves are typically more robust than the seal achieved by a blow-out-preventer sealed around a tubing or lubricator sealed around a wire, and multiple valves can be used to ensure a redundant seals that meet regulatory requirements. In certain instances, the valve 20 can be of a type having a metal to metal, gas tight seal.

The exercise tool assembly 12 can be operated to cycle the actuator sleeve of the well tool 24 uphole and downhole, and thus operate the well tool 24 to open and close, as many times as is desired without intervention into the well. For example, the exercise tool assembly 12 can be operated by alternately increasing pressure and decreasing pressure in the central bore of the completion string 22 relative to a specified pressure. In certain examples, the specified pressure is the pressure that the exercise tool assembly 12 was equalized at (i.e., the pressure in the central bore when the equalizing valve of the exercise tool assembly 12 was closed). For example, fluids can be pumped into and released from the central bore via a port in the wellhead 16. In certain examples of a subsea well, the fluids can be pumped into the well 10 using a subsea remote operated vehicle (ROV) or another remote surface or subsea pump system. As methanol is typically readily available at subsea wells for prevention of hydrates, the fluid pumped into the well, in certain instances, can be methanol and/or other treatment chemicals used in the well completion or production. Still other fluids can be used. In one example, the exercise tool assembly 12 strokes down (i.e., expands) in response to increased pressure in the central bore, thus causing the exercise tool assembly 12 to move the well tool 24 actuator sleeve downhole and operate the well tool 24 one half of a cycle. The exercise tool assembly 12 strokes up (i.e., contracts) in response to decreased pressure in the central bore to retract the well tool 24 sleeve uphole and complete the cycle. In certain instances, the exercise tool assembly 12 can be spring biased to a retracted state to facilitate contracting in response to decreased pressure. In other instances, the exercise tool assembly 12 can be alternately configured to contract upon increases in pressure in the central bore and expand in response to decreased pressure. The actuator system of the well tool 24 (i.e., the system that would normally be operated to operate the well tool 24) can, in certain instances, be operated in cooperation with the exercise tool assembly 12 to facilitate cycling the well tool 24. In other instances, the actuator system of the well tool 24 can be not operated and the well tool 24 cycled by operation of the exercise tool assembly 12 alone.

The exercise tool assembly 12 can be removed by running the running tool 28, or a specific pulling tool, back into completion string 22 on wire and/or tubing and engaging the fishing neck of the exercise tool assembly 12. Withdrawing the exercise tool assembly 12 releases the engagement and gripping of the exercise tool assembly 12 with the well tool 24, allowing the exercise tool assembly 12 to be pulled from the well 10.

Turning now to FIGS. 2A-D, an example exercise tool assembly 200 is shown in half side cross section in connection with an example well tool and running tool, SCSSV 210 and running tool 212. The example exercise tool assembly 200 can be used as the exercise tool assembly 12, and like the exercise tool assembly 12, the example exercise tool assembly 200 can be used in other types of well tools than the specific SCSSV 210 depicted. The exercise tool assembly 200 includes a lock mandrel 244 coupled (threadingly and/or otherwise) to an exercise sub 288, and an equalizing valve 246 received in the exercise sub 288. In other instances, the features of the lock mandrel 244 and/or equalizing valve 246 can be integrated into a single tool. Also, although depicted with a specific lock mandrel 244 and equalizing valve 246, there are other types of lock mandrels and equalizing valves that could be used.

The example SCSSV 210 is a primarily hydraulically operated valve configured to remain open in response to a hydraulic signal received through a control line 214 and close when the hydraulic signal at the control line 214 is reduced or ceased. The hydraulic signal is a hydraulic pressure above a specified control pressure. The pressure acts on an actuator piston 216 of the SCSSV 210 to drive the piston 216 downhole (toward the right of FIG. 2A) to an actuated position. The piston 216, in turn, engages an actuator sleeve 218 of the SCSSV 210 and drives the actuator sleeve 218 downhole to its actuated position. The actuator sleeve 218 interacts with the valve closure 220 to open the valve closure 220, and allow flow through the central bore 226 of the SCSSV 210, when in the actuated position. In the example depicted, the valve closure 220 is a flapper spring biased closed to seal against flow through the central bore 226, and the actuator sleeve 218 pushes the flapper open when moved downhole to its actuated position. In other examples, the valve closure 220 can be a ball valve, and the actuator sleeve 218 is coupled to the linkage that rotates the ball. A return spring 222 reacts between a fixed location on the SCSSV housing 224 and the actuator sleeve 218 to bias the actuator sleeve 218 and piston 216 uphole to their respective unactuated positions, thus allowing the SCSSV 210 to default with the valve closure 220 closed. Notably, as a safety valve, the primary actuator system of the SCSSV 210 is the hydraulic actuation system, including the control lines 214 and actuator piston 216. The example SCSSV 210 has provisions for contingency operation apart from the hydraulic actuation system, for example, if the hydraulic actuation system fails or cannot produce enough force to open the closure 220. Particularly, the SCSSV 210 includes a key engaging profile 228 in the interior of the actuator sleeve 218 that allows the actuator sleeve 218 to be engaged by keys of a shifting tool deployed in a working string. Once engaged, the shifting tool can be used to manually manipulate the actuator sleeve 218 via the working string and without hydraulically operating the hydraulic actuation system.

Figure 2A:
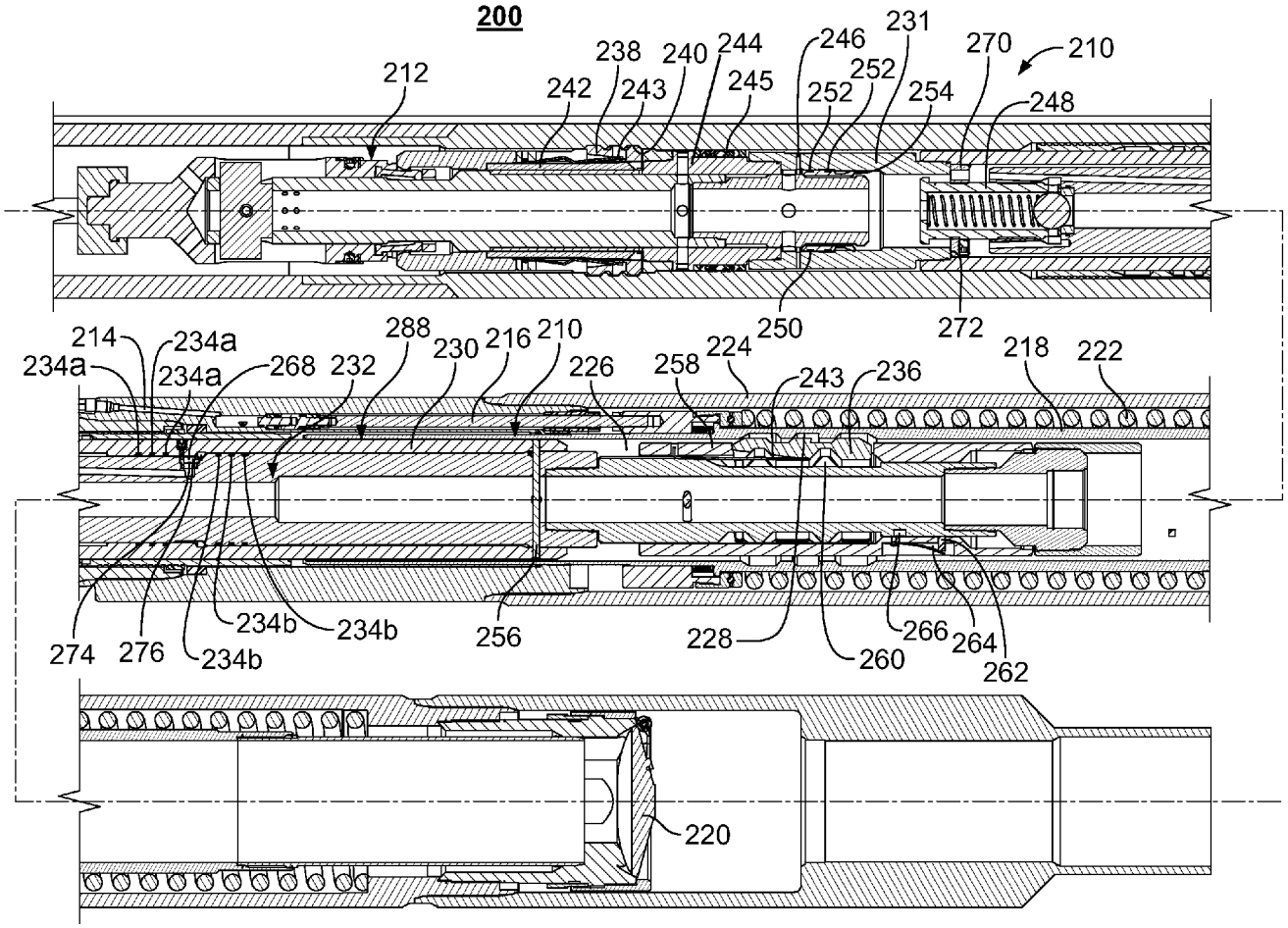
FIGS. 2A-2C are side cross-sectional views of a Surface Controlled Subsurface Safety Valve with an example exercise tool assembly received in its central bore. The views sequentially depict the operation of the exercise tool assembly.

The exercise tool assembly 200 is depicted in FIG. 2A as set in the SCSSV 210 engaged with the SCSSV 210, and partially locked to the SCSSV 210. The exercise tool assembly 200 has been carried into the well and into the SCSSV 210 on the running tool 212, and as will be discussed in more detail below, the pressure uphole and downhole of the exercise tool assembly 200 has been equalized.

The running tool 212 depicted is an Otis RO running tool, where OTIS is a registered trademark of Halliburton Energy Services, Inc. However, other, different running tools could be used.

The exercise sub 288 includes a cylinder mandrel 230 and a piston mandrel 232 in and sealed with (via seals 234*a* and 234*b*) the interior of the cylinder mandrel 230. The piston mandrel 232 carries a plurality of exercise keys 236 arrayed around its circumference. The piston mandrel exercise keys 236 are configured to engage and grip the exercise profile 228 of the actuator sleeve 218. The lock mandrel key retainer 244 carries another set of lock keys 238 arrayed around its circumference and axially spaced from the exercise keys 236. The lock mandrel keys 238 are configured to engage and grip the lock mandrel profile 240, a profile provided apart from the actuator sleeve 218. For example, FIG. 2A shows a lock mandrel profile 240 in the wall of the SCSSV housing 224 that is engaged by lock mandrel keys 238, but the profile 240 could be at another location above the SCSSV 210. The lock mandrel keys 238 are each spring biased radially outward by springs 243. The exercise keys 236 are each spring biased radially outward by springs 243. Being spring biased as such allows the keys 236, 238 to slide along the interior of the central bore 226 as the exercise tool assembly 200 is run into the SCSSV 210, and snap into initial engagement when the exercise tool assembly 200 is fully received in the SCSSV 210 and the lock mandrel keys 238 align with the lock mandrel profile 240. The keys of the exercise sub 236 are positioned so they will engage and lock into the exercise profile 228 when they shift down. The illustrated lock profile 240 and lock mandrel 238 are configured with a no-go type initial engagement that stops further downhole movement of the exercise tool assembly 200 as it is being received into the SCSSV 210 to precisely position the exercise tool assembly 200 relative to the SCSSV 210.

The lock mandrel 244 internally receives a key expander mandrel 242 that can translate axially within the lock mandrel 244 between a position radially beneath the lock mandrel keys 238 and a position apart from the lock mandrel keys 238. When positioned radially beneath the lock mandrel keys 238, the key expander mandrel 242 locks the keys 238 in a radially expanded position. For example, as seen in FIG. 2A, when the lock mandrel keys 238 are initially positioned aligned with the profile 240, translating the key expander mandrel 242 radially beneath the lock mandrel keys 238 locks the keys into gripping engagement with the lock mandrel profile 240. The key expander mandrel 242, however, is initially held apart from the lock mandrel keys 238 by a shear pin (not shown). The running tool 212 engages the internal fishing neck which attaches to the key expander mandrel 242. Once the exercise tool assembly 200 is located in position with the lock mandrel keys 238 in the SCSSV 210, the jars and stem (not shown) are used to jar down on the running tool 212 on the fishing neck, shearing the shear pin and locking the keys of the lock mandrel 238 propped into the lock profile 240. With the lock mandrel keys 238 locked in gripping engagement with the profile 240, the exercise tool assembly 200 is locked to the SCSSV 210, and cannot move uphole or downhole. Thereafter, the tool string and the running tool 212 can be released and withdrawn uphole from the exercise tool assembly 200 and the well.

The lock mandrel 244 carries seals 245 around its circumference that are configured to seal with the interior of the central bore 226. Thus, pressure above the valve closure equalization pressure applied uphole in the central bore 226 is communicated through the lock mandrel 244 and cylinder mandrel 230 to act on the piston mandrel 232 and drive the piston mandrel 232 axially downhole relative to the lock mandrel 244 and mandrel 230.

The equalizing valve 246 has one or more equalizing ports downhole of the seal 245 to communicate the interior and exterior of the cylinder mandrel 230 while the exercise tool assembly 200 is being run into/out of the SCSSV 210 and well. The downhole end of the lock mandrel 244 is open to allow fluid communication through the interior of the lock mandrel 244. However, the piston mandrel 232 includes a check valve 248 that seals against communication of fluid from uphole of the piston mandrel 232 downhole, and allows communication of fluid from downhole of the piston mandrel 232 uphole of the piston mandrel 232. The check valve 248 is shown as a ball that is spring biased into a seat, but it could take other forms. The equalizing valve ports 246 and check valve 248 cooperate to allow higher pressure downhole of the exercise tool assembly 200 to equalize uphole of the exercise tool assembly 200 when it is run into the SCSSV 210, thus allowing the pressure to be equalized uphole and downhole of the exercise tool assembly 200 to a specified pressure. In certain instances, the pressure is equalized at hydrostatic pressure in the well bore.

Figure 2B:
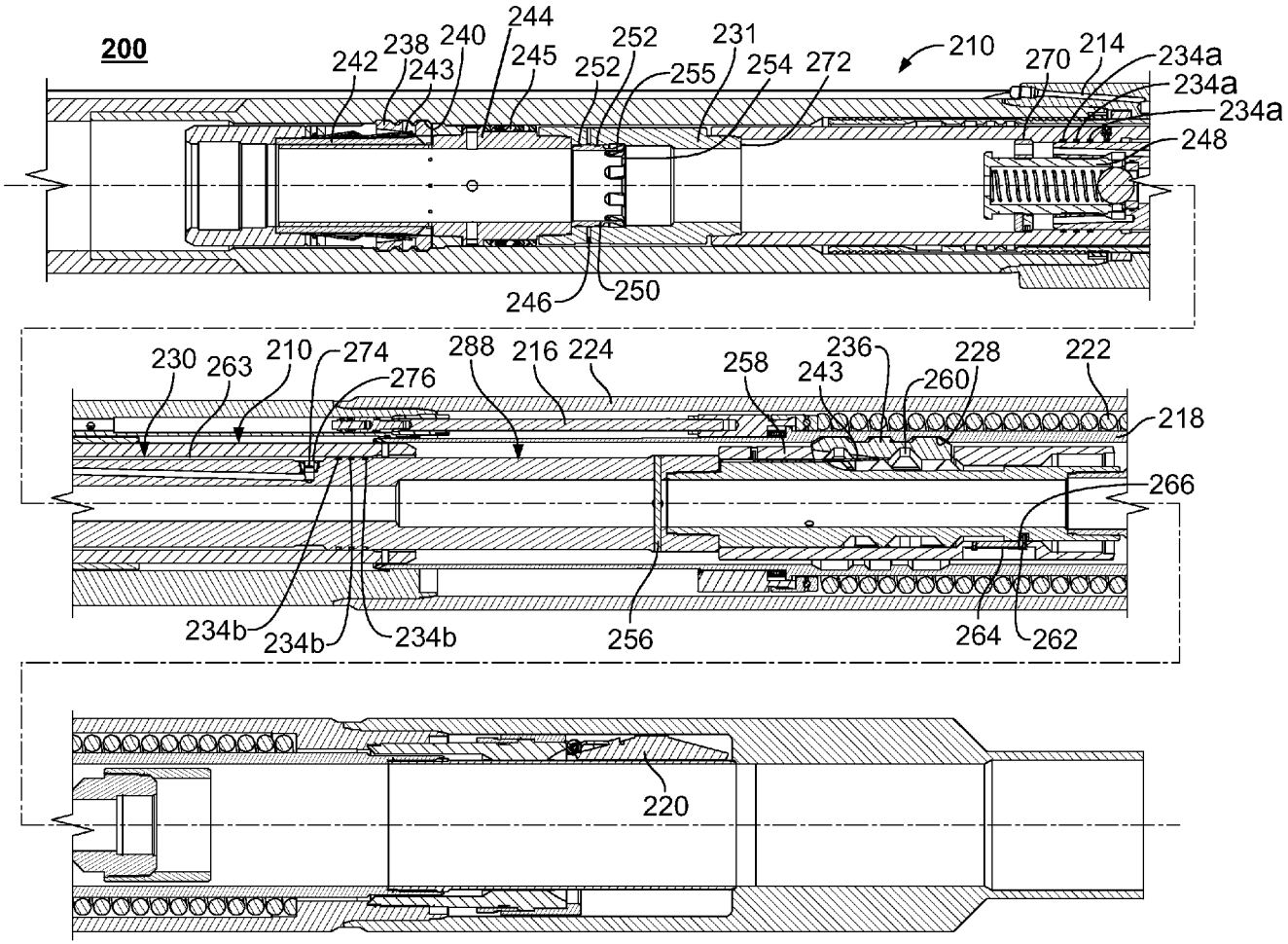
Figure 2C:
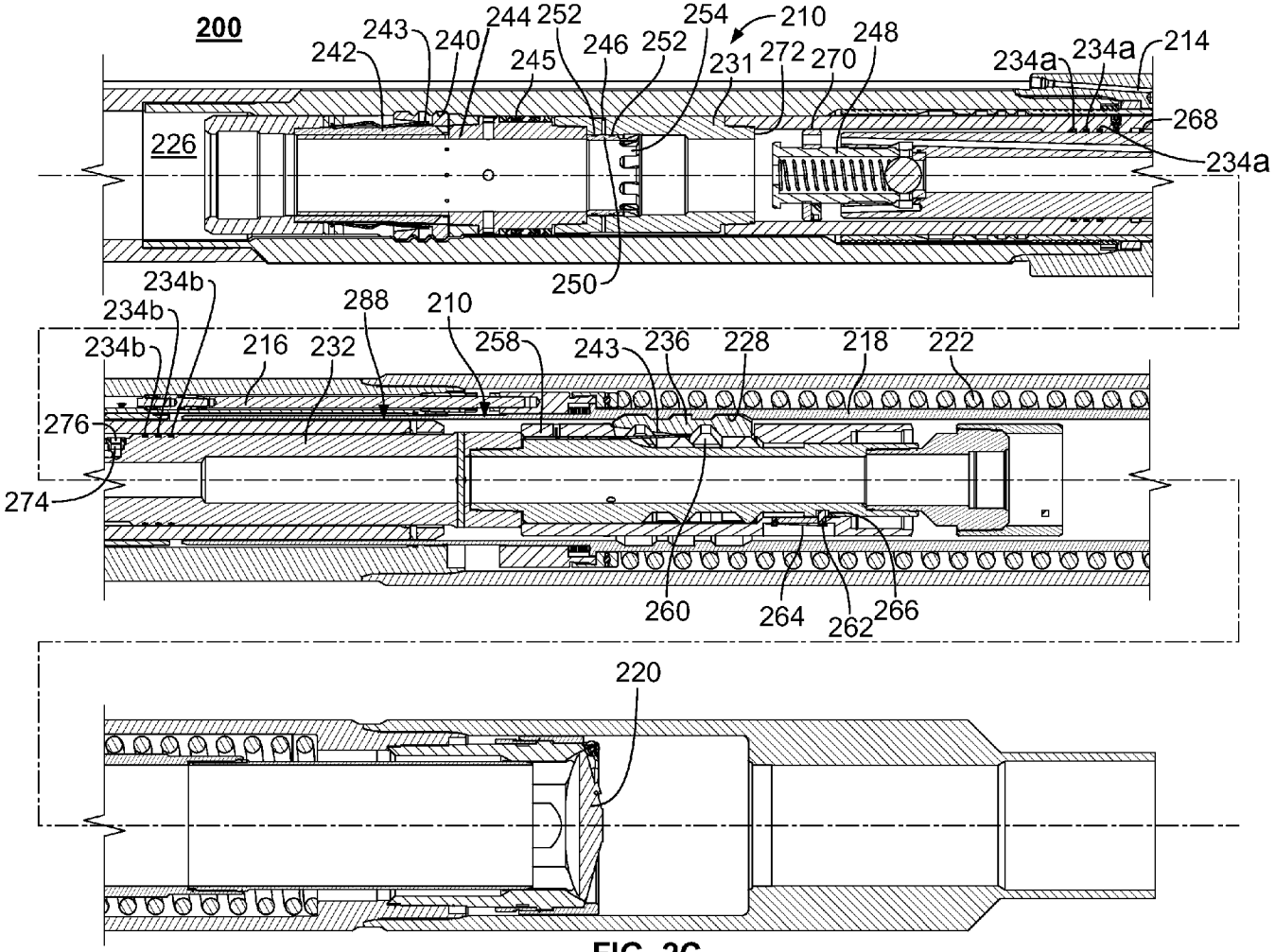
Figure 2D:
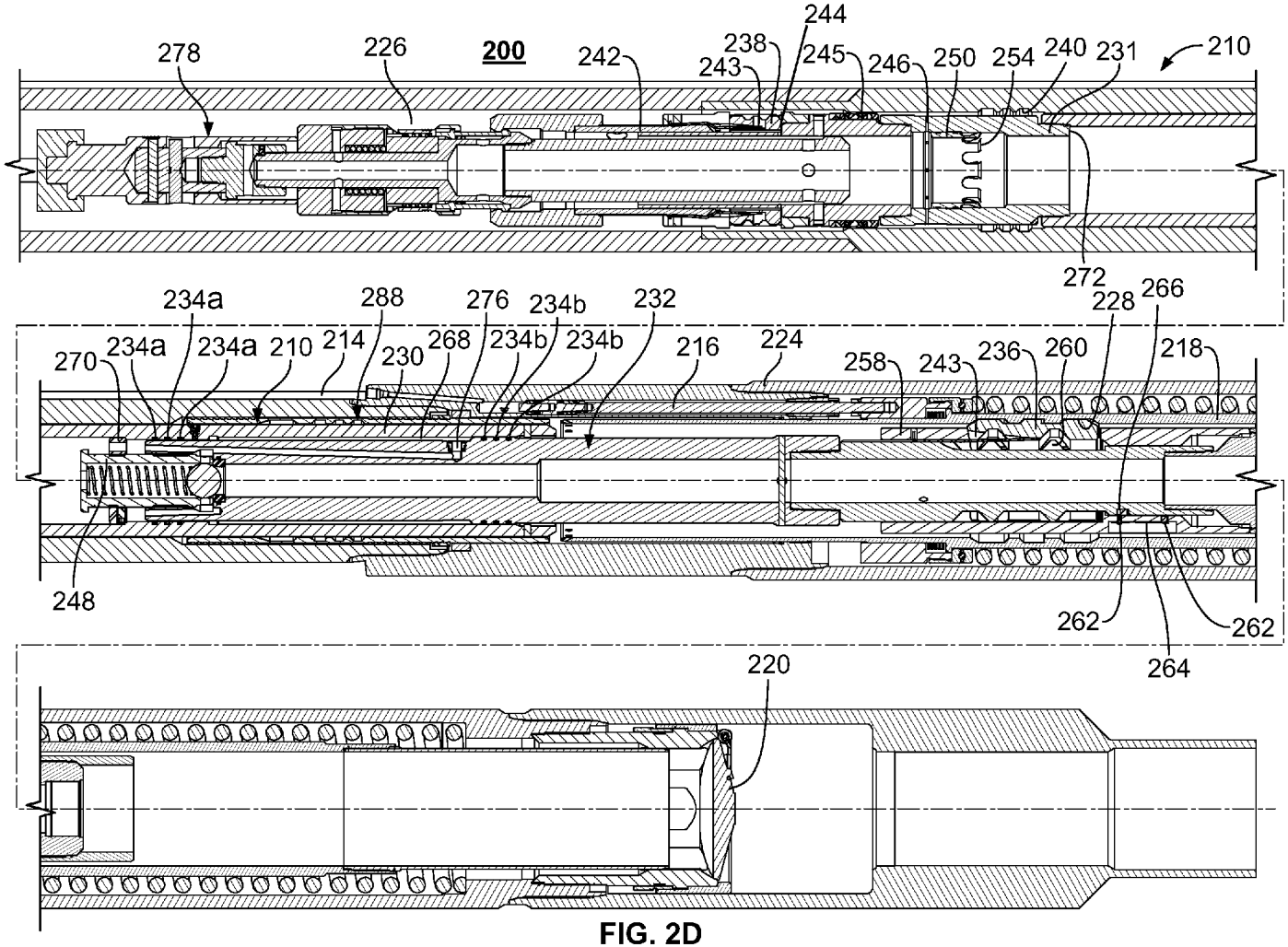
FIG. 2D depicts the exercise tool assembly coupled to a pulling tool. The exercise tool assembly is equalized and prepared to be pulled from the SCSSV and the well.

The equalizing valve housing 231 internally receives a sealing sleeve 250 that has two axially spaced apart seals 252 that seal against the interior of the equalizing valve housing 231. The sealing sleeve 250 can axially translate between a downhole position, where both seals 252 are downhole of the equalizing ports 246 and allow fluid communication through the ports 246, and an uphole position where the seals 252 bracket the ports 246 and seal against fluid communication through the ports 246. The sealing sleeve 250 is initially in the downhole position when the exercise tool assembly 200 is run into the well (FIG. 2A) and pressure is equalized. The sealing sleeve 250 includes one or more spring fingers 254 that are biased radially outward but held radially inward by the inner wall of the equalizing valve housing 231 to grip the downhole, prong end of the running tool 212. When the running tool 212 is withdrawn uphole from the exercise tool assembly 200, the sleeve 250 is translated uphole to seal the ports 246. The spring fingers 254 are also moved to a larger diameter portion 255 of the equalizing valve housing 231 to allow the spring fingers 254 to expand outward, release from the prong end of the running tool 212 and release the sleeve 250 from the running tool 212 (FIG. 2B). The spring fingers 254 then abut the downhole end of the larger diameter portion 255 to retain the sleeve 250 sealing the ports 246.

The piston mandrel 232 is initially fixed to the cylinder mandrel 230 by a shear pin 256 when the exercise tool assembly 200 is run into the well (FIG. 2A). With the cylinder mandrel 230 locked into the profile 240, applying pressure uphole through the central bore 226 drives the piston mandrel 232 downhole and shears the pin 256 to release the piston mandrel 232 from the cylinder mandrel 230 (FIG. 2B).

The exercise keys 236 are retained in the key retainer sleeve 258 received over and configured to translate axially relative to the piston mandrel 232. The outer surface of piston mandrel 232 proximate the keys 236 defines a key expander profile 260. When the piston mandrel 232 is retained to the cylinder mandrel 230 by the shear pin 256 (FIG. 2A), the key expander 260 is axially positioned to allow the keys 236 to radially retract. However, when pressure is applied uphole through the central bore 226, the shear pin 256 is sheared, and the piston mandrel 232 is translated downhole, the key expander 260 is moved to an axial position that locks the keys 236 radially extended into gripping engagement with the actuator sleeve profile 228 (FIG. 2B). One or more shear pins 262 are carried by the key retainer sleeve 258 and biased inward by springs 264. When the piston mandrel 232 translates downhole to lock the keys 236 radially expanded, the shear pin(s) 262 spring inward into a shear pin receptacle 266 of the piston mandrel 232 and fixes the piston carrying sleeve 258 to the piston mandrel 232 with the keys 236 locked radially expanded. Further pressure applied uphole through the central bore 226 drives the piston mandrel 232 further downhole to drive the actuator sleeve 218 downhole. The reaction forces of driving the actuator sleeve 218 downhole are born by the keys 238. Notably, the piston area presented by the piston mandrel 232 and check valve 248 (i.e., the area within seals 234*a*) is substantially larger than the piston area presented by the actuator pistons 216 of the SCSSV 210. Therefore, a much larger maximum force is applied to drive the actuator sleeve 218 downhole via pressure applied to the exercise tool assembly 200 than via the same magnitude of pressure applied to the actuator piston 216 of the SCSSV 210. In certain instances, pressure can be applied to both the exercise tool assembly 200 and the actuator piston 216 of the SCSSV 210 concurrently to maximize the force applied to drive the actuator sleeve 218 downhole.

An adjusting nut 270 coupled to the piston mandrel 232 abuts a corresponding limiter shoulder 272 on the cylinder mandrel 230 to limit the downhole translation or stroke of the piston mandrel 232 relative to the cylinder mandrel 230 (FIG. 2B). In the figures the adjusting nut 270 is threaded to the exterior of the check valve 248, so its position can be axially adjusted relative to the piston mandrel 232 to enable adjustment of the stroke. In other instances, the adjusting nut 270 can be coupled to the piston mandrel 232 in a different manner (e.g., on the piston mandrel 232 itself or to another component) and need not be threaded. The adjusting nut 270 enables adjusting the stroke of the exercise tool assembly 200 relative to the stroke of the actuator sleeve 218 (e.g., to be equal, slightly shorter, or other) so that operation of the exercise tool assembly 200 does not over extend and damage the actuator sleeve 218 or SCSSV 210.

A return spring is provided to return the piston mandrel 232 axially uphole relative to the cylinder mandrel 230 when uphole pressure through the central bore 226 is reduced back to the equalization pressure. In FIG. 2A, the return spring is a fluid type spring defined by chamber 268 between the piston mandrel 232 and cylinder mandrel 230 and sealed by seals 234*a* and 234*b*. The chamber 268 can be sealed when the piston mandrel 232 and cylinder mandrel 230 are axially contracted, for example, when pinned by the shear pin 256. In certain instances, the fluid in the chamber is at atmospheric pressure when the piston mandrel 232 and cylinder mandrel 230 are sealed in the axially contracted state. Thereafter, when the piston mandrel 232 is axially extended from the cylinder mandrel 230 downhole, the chamber 268 is enlarged and a pressure less than atmospheric pressure is created in the chamber 268. When pressure is released from the central bore 226 and control line 214, the differential pressure between the chamber pressure versus the hydrostatic pressure forces the piston mandrel 232 back into the cylinder mandrel 230, and returns the actuator sleeve 218 uphole. In the case of a SCSSV 210, the return spring 222 of the SCSSV 210 will also assist in pushing the piston mandrel 232 back into the cylinder mandrel 230 and the actuator sleeve 218 uphole.

Notably, although described as a fluid spring that operates by reducing pressure within the chamber 268 (i.e., vacuum), the fluid spring could operate on increasing the pressure in the chamber 268, for example, with the chamber being configured to reduce in size and compress a gas in the chamber when the piston mandrel 232 is axially extended from the cylinder mandrel 230. Alternatively, or in addition to a fluid spring, a mechanical spring could be used (e.g., coil spring, Belleville washers, and/or another mechanical spring) between the piston mandrel 232 and cylinder mandrel 230.

The operations described above to extend and retract the piston mandrel 232 and actuator sleeve 218 can be repeated once, twice, or as many times as is desired. Further, in the instance of an SCSSV 210, the valve closure 220 can be pressure tested with pressure downhole of the closure 220. If there is any leakage past the valve closure 220, the exercise tool assembly 200 will not retain the pressure, but rather will allow communication of the pressure uphole through the check valve 248.

When it is desired to remove the exercise tool assembly 200, the tool can be disabled to facilitate removal from the well. To this end, the fluid spring of atmospheric chamber 268 has a relief port 276 in fluid communication with the central bore 226. The relief port 276 is sealed by a pressure relief plug 274, such as a rupture disk, pressure relief valve and/or other device, that seals the port 276 until exposed to pressure over a specified pressure. Once over the specified pressure, the pressure relief plug 274 opens (FIG. 2D) to allow fluid communication with the interior of the cylinder mandrel 230, thus disabling the return spring. For example, when it is desired to disable the exercise tool assembly 200, the specified pressure can be applied through the central bore 226 to open the plug 274. In certain instances, the specified pressure is selected to be above the expected pressures experienced when operating the exercise tool assembly 200 to cycle the actuator sleeve 218.

A pulling tool 278 (FIG. 2D) can be used to equalize the pressure through the equalizing valve 246 and release the lock mandrel keys 238 from gripping engagement with the locking mandrel profile 240. The pulling tool 278 is run into the lock mandrel 244 to push the equalizing valve 246 to the open position. Upward jarring on the pulling tool 278 releases the lock mandrel keys 238 from the lock profile 240. The pulling tool 278 is shown as run into/out of the well on wireline, but could be run into/out of the well on tubing. The pulling tool 278 (FIG. 2D) can be used to jar the cylinder mandrel 230, and the piston mandrel 232 with it, uphole relative to the key retainer sleeve 258 and the exercise keys 236, which are still engaged to the actuator sleeve 218. The uphole jarring shears the shear pin(s) 262 and releases the piston carrying sleeve 258 from the piston mandrel 232, allows the exercise keys 236 to be unsupported by the expander mandrel 260, and allows the exercise keys 236 to be pulled uphole from the actuator sleeve profile 228. Because the shear pin 262 is sheared by an uphole movement, the actuator sleeve 218 is left in an uphole position. Further uphole translation of the pulling tool 278 withdraws the exercise tool assembly 200 from the SCSSV 210 and from the well. Thereafter, the SCSSV 210 is left for normal operation.

A number of embodiments have been described. Nevertheless, it will be understood that various modifications may be made. Accordingly, other embodiments are within the scope of the following claims.

What is claimed is:

1. An exercise tool assembly for operating a downhole tool auxiliary to a primary actuator system of the downhole tool, the exercise tool assembly comprising:

a cylinder mandrel configured to be received in a central bore of the downhole tool; and a piston mandrel in and sealed with the cylinder mandrel, the exercise tool assembly configured to couple to an actuator sleeve of the downhole tool and to couple to the downhole tool at a location apart from the actuator sleeve, the piston mandrel responsive to an increase or decrease in pressure in the central bore to translate relative to the cylinder mandrel and translate the coupling with the actuator sleeve relative to the coupling at the location apart from the actuator sleeve, where the piston mandrel is responsive to an increase in pressure to translate from a first position to a second position, and the exercise tool assembly comprises a return spring configured to return the piston mandrel to the first position in response to a decrease in pressure; and where the primary actuator system of the downhole tool is operated by a hydraulic signal and has a first hydraulic area on which the hydraulic signal acts, and where the piston mandrel has a second hydraulic area that is larger than the first hydraulic area.

2. The exercise tool assembly of claim 1, where the return spring comprises a pressure chamber.

3. The exercise tool assembly of claim 2, where the pressure chamber comprises a gas at or near atmospheric pressure.

4. The exercise tool assembly of claim 1, where the exercise tool assembly is configured to couple to a wire or a tubing to be carried downhole on the wire or tubing and the exercise tool assembly is configured to release from the wire or tubing while downhole.

5. The exercise tool assembly of claim 4, where the exercise tool assembly is configured to translate the coupling with the actuator sleeve relative to the coupling at the location apart from the actuator sleeve when the exercise tool is released from the wire or tubing.

6. The exercise tool assembly of claim 1, where the exercise tool assembly is configured to couple to a wire to be carried downhole on the wire and operate to translate the coupling with the actuator sleeve relative to the coupling at the location apart from the actuator sleeve while the wire is slack.

7. The exercise tool assembly of claim 1, where the downhole tool comprises a downhole valve and the actuator sleeve is coupled to a closure of the valve to open the central bore when the actuator sleeve is translated in a first direction and to close the central bore when the actuator sleeve is translated in a second direction.

8. A method of operating a downhole tool auxiliary to a primary actuator system of the downhole tool, the method comprising:

carrying an exercise tool assembly downhole with a wire or tubing coupled to the exercise tool assembly and releasing the wire or tubing from the exercise tool assembly;

gripping, with the exercise tool assembly, a wall of a central bore of the downhole tool;

gripping, with the exercise tool assembly, an actuator sleeve of the downhole tool;

then shifting the actuator sleeve in a first direction with the exercise tool in response to a pressure increase of fluid in the central bore to operate the downhole tool;

shifting the actuator sleeve in a second direction using a spring of the exercise tool in response to a pressure decrease of fluid in the central bore to operate the downhole tool; and withdrawing the wire or tubing from a well containing the exercise tool assembly and closing in the well with a valve uphole from the exercise tool prior to and during shifting the actuator sleeve with the exercise tool assembly.

9. The method of claim 8, further comprising, in response to a second pressure increase of fluid of the central bore, shifting the actuator sleeve in the first direction; and in response to a second pressure decrease of fluid of the central bore, shifting the actuator sleeve in the second direction.

10. The method of claim 8, where shifting the actuator sleeve in the second direction comprises expanding a fluid in a pressure chamber of the exercise tool assembly.

11. The method of claim 8, where the downhole tool is a valve and the actuator sleeve is coupled to a closure of the valve to open the central bore when the actuator sleeve is translated in a first direction and to close the central bore when the actuator sleeve is translated in a second direction.

* * * * *